US005676871A

United States Patent [19]

Graves

[11] Patent Number: 5,676,871

[45] Date of Patent: Oct. 14, 1997

[54] ENERGY EFFICIENT HAIR CURLER SYSTEM

[76] Inventor: Carol Anne Graves, 3400 Tilden St., Brentwood, Md. 20722

[21] Appl. No.: 469,695

[22] Filed: Jun. 6, 1995

[51] Int. Cl.[6] ..... H05B 3/06

[52] U.S. Cl. ..... 219/521; 219/222; 219/385

[58] Field of Search ..... 219/521, 385, 219/222, 226, 227, 242, 679, 762; 132/227–229; 422/104, 297, 299; 220/524

[56] References Cited

U.S. PATENT DOCUMENTS

| | | | |
|---|---|---|---|
| 1,579,476 | 4/1926 | Dominguez | 219/521 |
| 3,283,122 | 11/1966 | McNair | 219/222 |
| 3,666,915 | 5/1972 | Napoli | 219/222 |
| 3,705,974 | 12/1972 | Nilsson | 219/222 |
| 3,858,029 | 12/1974 | Walter | 219/222 |
| 4,647,755 | 3/1987 | Mack | 219/222 |
| 5,482,060 | 1/1996 | Barradas | 132/226 |

FOREIGN PATENT DOCUMENTS

| | | | |
|---|---|---|---|
| 64207 | 1/1946 | Denmark | 132/229 |
| 1051578 | 12/1966 | United Kingdom | 219/521 |

*Primary Examiner*—Teresa J. Walberg
*Assistant Examiner*—Raphael Valencia
*Attorney, Agent, or Firm*—Paul M. Craig, Jr.

[57] ABSTRACT

A hair curler system in which a number of hair curlers and curler lifters are stored in individual compartments insulated with respect to one another and with respect to the outside to thereby effectively improve energy efficiency of the curler system. The individual compartments are formed by cored-out insulation or by individual heat tubes either of test-tube-like shape having an open or closed bottom or of an inwardly recessed bottom to receive heat posts or rods on a heat plate or accommodate lossy dielectric material.

63 Claims, 8 Drawing Sheets

FIG. 7
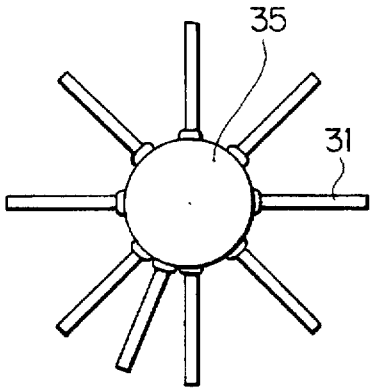
FIG. 9
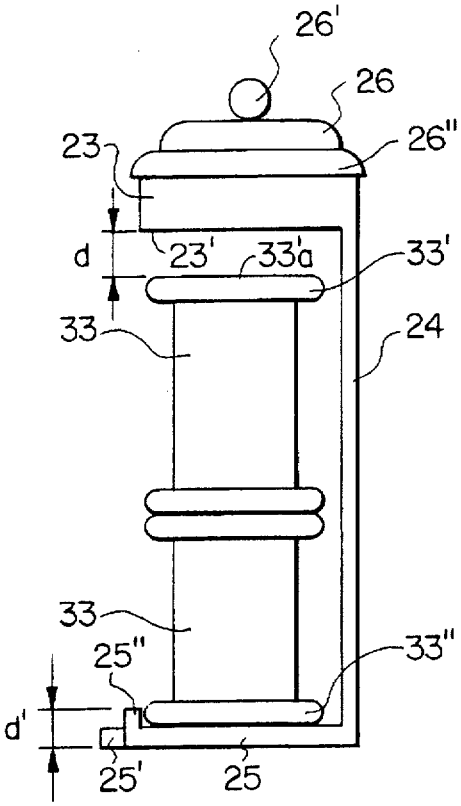
FIG. 9A
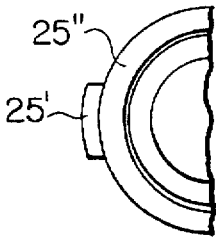
FIG. 8
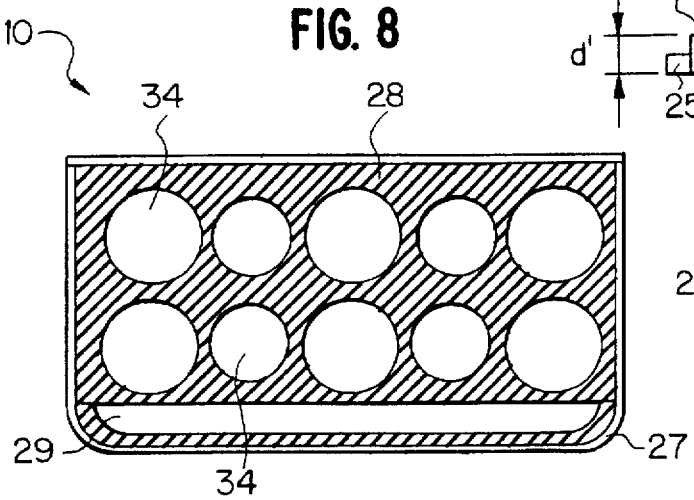
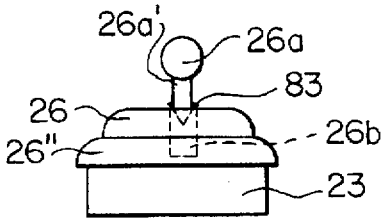
FIG. 16
FIG. 13
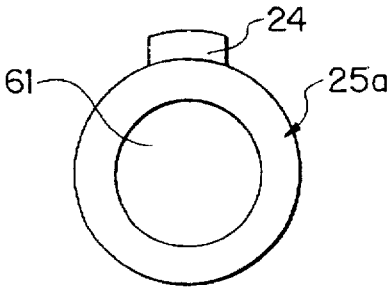
FIG. 14
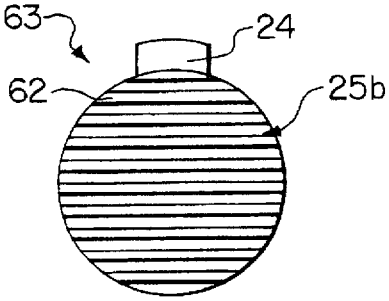

FIG. 10
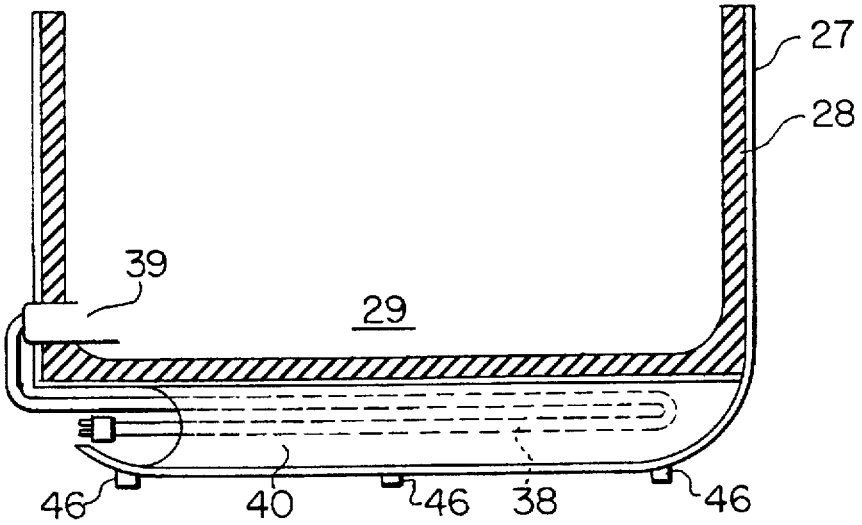
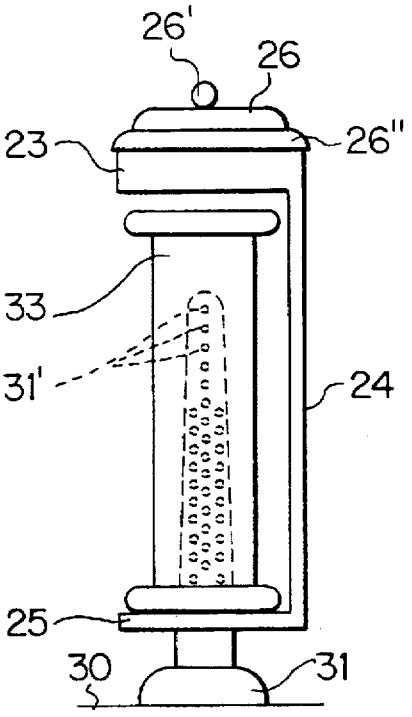
FIG. 11
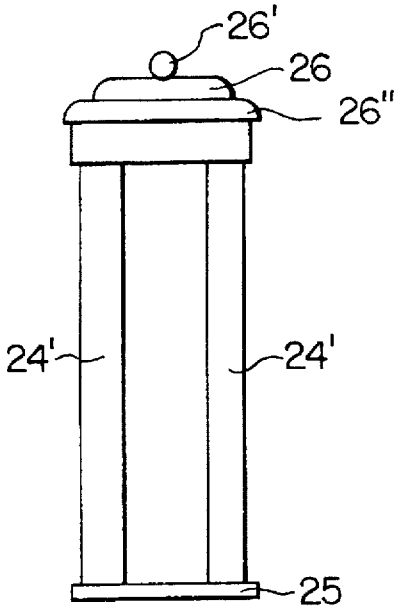
FIG. 12

ENERGY EFFICIENT HAIR CURLER SYSTEM

FIELD OF THE INVENTION

The present invention relates to hair-curler systems and to a method of using the same.

BACKGROUND OF THE INVENTION

A multitude of devices are commercially available in which hair curlers are placed in a plastic container that includes an electric heating system attached to rods or the like which can be inserted into the curlers. These prior art devices for the most part are energy inefficient because when a hair curler is removed, the remaining curlers experience a notable amount of heat loss due to the fact that the surfaces of the other curlers are exposed to ambient air temperature. Moreover, in some of these devices, all of the hair curlers are exposed to the room temperature air during the entire curler "setting" time. Inefficiency in these prior art devices also arises from the fact that they have to be constantly connected to an electrical power source during the entire hair curler "setting" time to maintain a sufficiently high temperature in each hair curler to curl the hair. Lack of portability of the prior art devices is also a drawback in many instances because of the aforementioned requirements. Additionally, the prior art devices entail the drawback of involving relatively lengthy periods of time to adequately heat all of the curlers to assure proper curling of the hair. As the amount of electrical energy required for these prior art devices is directly related to the length of time to adequately heat the curlers and to maintain sufficient heat in the curlers, these factors contribute to energy inefficiency. Many of the prior art devices also left much to be desired with respect to compactness and safety, which is particularly true with so-called "steam" setters whose containers are of such shape as to be prone to tip over.

In addition or in the alternative, other forms of heating energy have been proposed for hair curlers, such as the use of microwave energy (U.S. Pat. Nos. 4,538,630; 4,710,609 and 5,030,820). Furthermore, various control systems have been proposed heretofore to control the temperature and length of time of heating the curlers including thermomagnetic temperature controls (U.S. Pat. No. 4,691,095). The U.S. Pat. Nos. 5,520,832 and 4,680,444 are representative of electrical devices for hair setter systems while U.S. Pat. No. 4,516,011 sought to improve the portability of such appliances.

Though hair curlers specifically designed for microwave heating are known in the prior art (U.S. Pat. No. 4,538,630 and U.S. Pat. No. 4,710,609), they are to be heated directly in microwave ovens rather than in a container as proposed by this invention, according to which the curlers are heated in and then kept hot in the container while each microwave-heated curler is awaiting its turn to be used on the hair after removal from the microwave oven.

SUMMARY OF THE INVENTION

It is a principal object of the present invention to avoid the shortcomings and drawbacks of the prior art by simple means which lend themselves readily to mass-production techniques and offer greater versatility and efficiency in the use of hair-curler systems.

The present invention obviates the shortcomings and drawbacks encountered with the prior art devices by a hair-curler system which assures high heat energy efficiency, is simple and compact in construction, heats all curlers rapidly; and the heat is used efficiently by enclosing the heat in the area where needed. Furthermore, this invention also permits removal of the individual curlers without attendant significant heat loss of the curlers remaining in the system and is readily adaptable for use both with electrical heating systems and/or microwave heating systems. Additionally, this invention permits manufacture of components which are safe for use in microwave ovens to offer extreme versatility in use, such as for steam setting, dry heat setting, and a combination of steam and dry heat setting, for example, by the use of some open-bottom heat tubes and some closed-bottom heat tubes in the same heat-curler system.

The underlying problems are solved according to the present invention in that the hair curler system of this invention is so constructed and arranged that removal of one of the hair curlers minimizes any loss of heat from the system. This is achieved according to this invention by individual compartments for each curler effectively insulated from the other compartments whereby a lifter device permits safe and easy removal of an individual hair curler from its compartment.

BRIEF DESCRIPTION OF THE DRAWINGS

These and other objects, features and advantages of the present invention will become more apparent from the following description when taken in connection with the accompanying drawing which shows, for purposes of illustration only, several embodiments in accordance with the present invention, and wherein:

FIG. 7 is a somewhat schematic plan view illustrating an arrangement of heating rods for use with the horizontal hair curler system of FIG. 6;

FIG. 8 is a somewhat schematic vertical cross-sectional view through still another modified hair-curler system of this invention with two rows of horizontally arranged compartments for hair curlers;

FIG. 9 is a somewhat schematic elevational view showing a hair curler lifter assembly of this invention which accommodates two small hair curlers per compartment;

FIG. 9A is a partial plan view on the bottom member of the curler lift assembly provided with a stop member to prevent accidental unwanted removal of the lift assembly from its compartment;

FIG. 10 is a somewhat schematic view illustrating a hair curler system of this invention with an electrical heating device and with a compartment at the bottom to accommodate an electric cord and other accessories of the system in accordance with the present invention;

FIG. 11 is a somewhat schematic elevational view of a curler lifter of this invention with the curler in place on a heating rod;

FIG. 12 is a somewhat schematic elevational view of a modified embodiment of a curler lifter which can be used in either horizontal, vertical or slanted position;

FIGS. 13 and 14 show modified embodiments of a lifter base member for use with a curler lifter assembly of this invention;

FIG. 16 is a somewhat schematic view of a cap member with lift knob for the hair curler lifter assembly of this invention to alert a person that a hair curler from the particular compartment is removed;

DETAILED DESCRIPTION OF THE INVENTION

Figure 1:
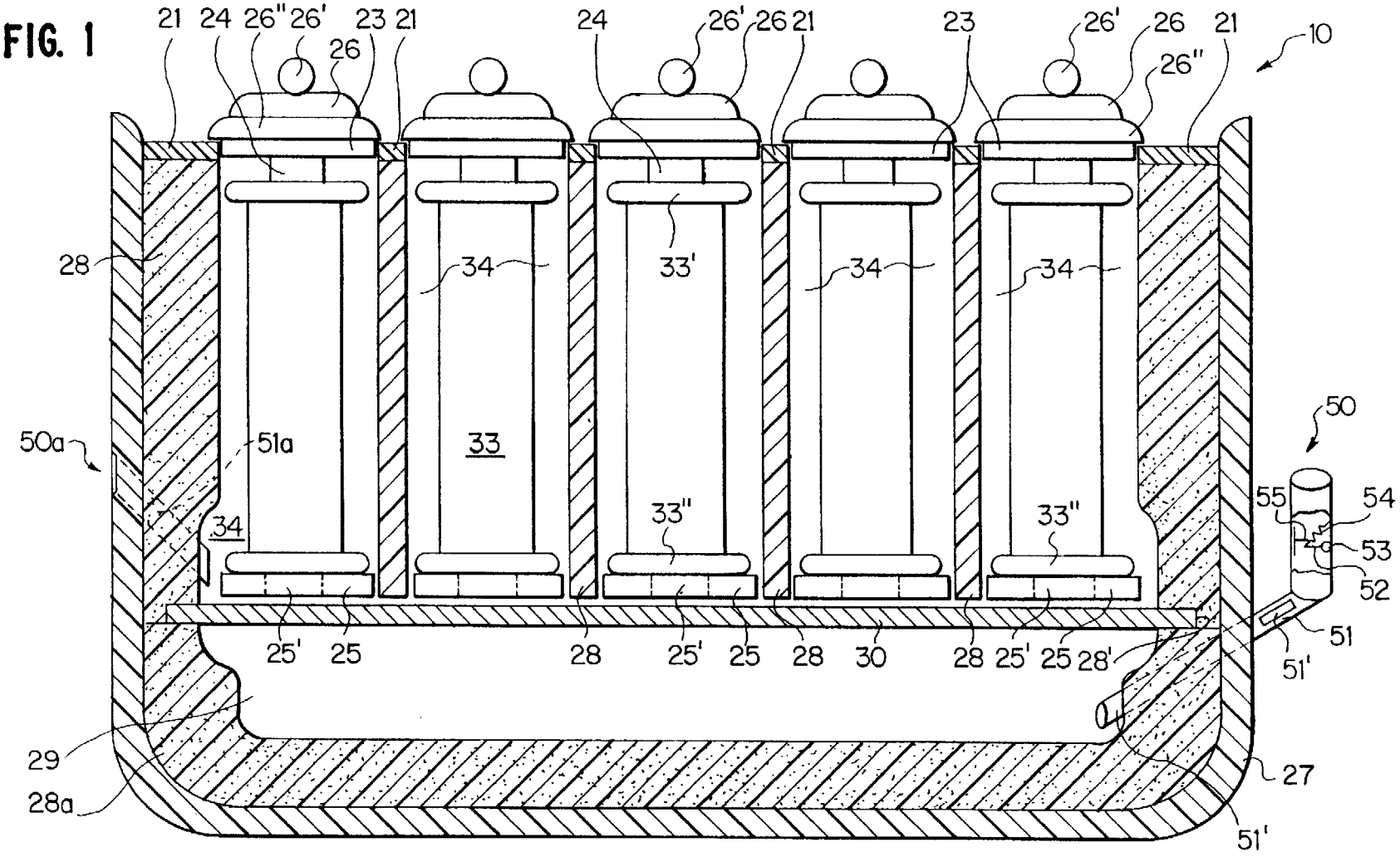
FIG. 1 is a somewhat schematic transverse cross-sectional view through one embodiment of a hair curler system in accordance with the present invention.
Figure 2:
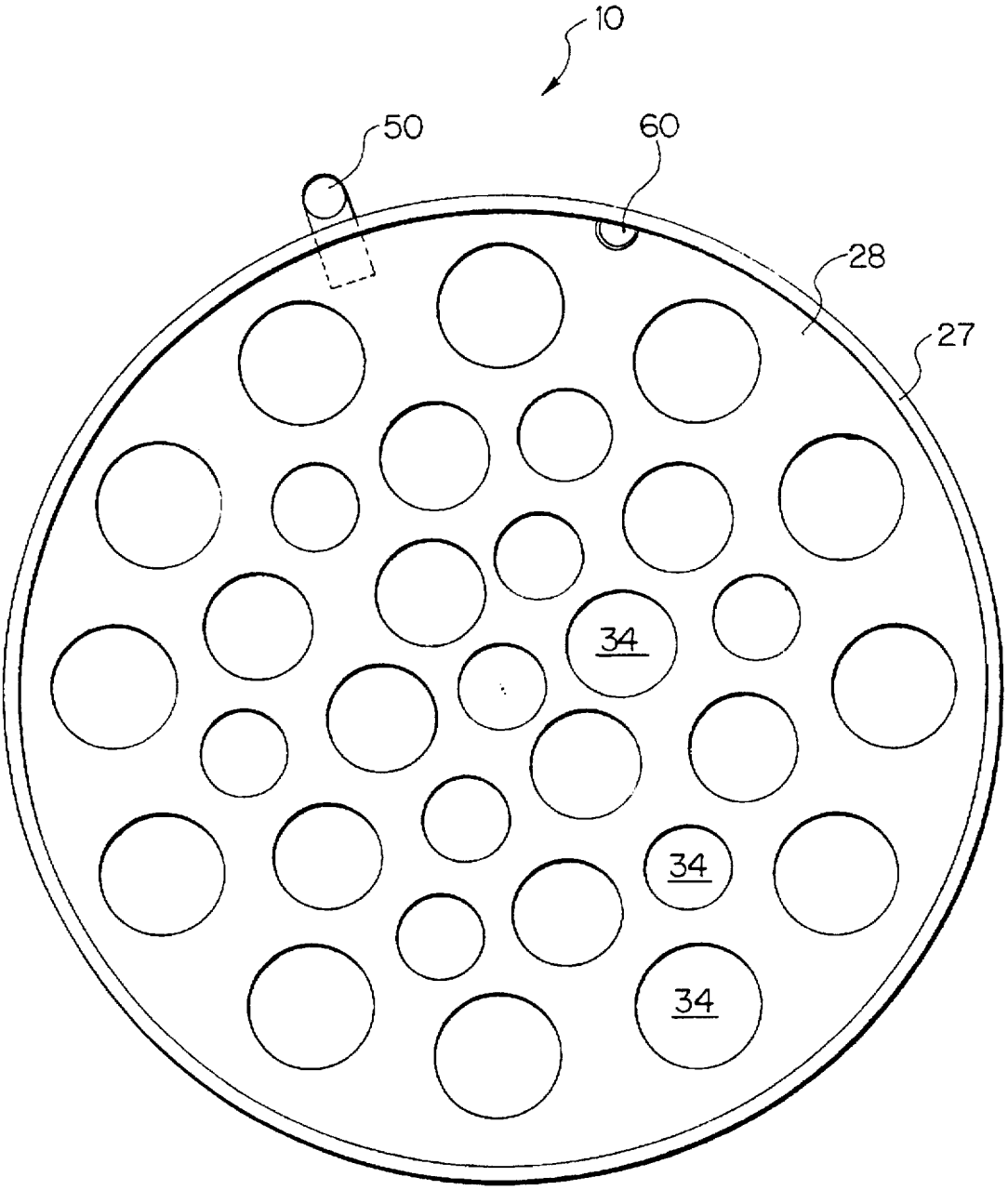
FIG. 2 is a somewhat schematic top plan view of the system of FIG. 1, with the top cover and caps removed.

Referring now to the drawing wherein like reference numerals are used throughout the various views to designate like parts, and more particularly to FIG. 1, reference numeral 10 generally designates one embodiment of a curler system in accordance with the present invention which includes an outer shell 27 forming a housing and made from a material transparent to microwave energy, for example, made from a form-rigid rubber-like material of conventional, commercially available type. In the illustrated embodiment the housing 27 is of circular shape (FIG. 2), but could be of any other appropriate shape, such as, oval, square, rectangular, polygonal, etc. The inside of the housing 27 is lined and filled with suitable insulating material 28, also transparent to microwave energy, such as, for example, Styrofoam, and suitably shaped as will be explained more fully hereinafter. The insulation 28 is provided with a circular recess or groove 28' to accommodate a heating disk 30 of complementary circular shape which forms a raised floor and is made from or includes a lossy dielectric material absorbing microwave energy and converting the same into heat or from a material absorbing heat energy from steam obtained by boiling water with the use of microwave energy, such as, for example, Corning Ware. A bottom cavity 29 is thereby formed between the bottom portion **28*a* of the insulation and the heat disk 30 which is used to store water to be heated by the microwave energy which in turn will heat the heating disk 30. However, the bottom cavity 29 may also remain empty for dry-setting, in which case the heat source would be located in another area in the system and may be formed, for example, by the heating disk 30 responsive to microwave energy or the cavity 29 itself may also be filled with a lossy dielectric material of any known, suitable type. Dry rice is a relatively cost-effective material for that purpose. The cover member 21 is cored out, and also the insulation 28 is cored out, as shown in FIG. 2, to provide a number of cylindrical holes 34, each forming a separate cylindrical compartment of any suitable number and dimensions as also of various shapes, if need be, to accommodate corresponding hair curlers (not shown in FIG. 2) which may be of any conventional type. Each compartment 34 is thereby insulated from each other compartment by the insulation 28. To permit the bottom cavity compartment 29 to be filled with water, a water fill device generally designated by reference numeral 50 and only schematically illustrated in FIGS. 1 and 2 includes a filler pipe 51 whose free inner end 51' extends into the bottom cavity compartment 29. A valve member 52 (FIG. 1) which is pivotally supported at 53 and which is spring-loaded by a spring 54 into its closing position where it abuts against an internal valve abutment 55 is thereby of such construction that the valve 52 will open only when a force is exerted thereon in the downward direction, for example, by the water head or by opening of the valve by means of a suitable tool such as a pencil or the like. In the microwave version, all parts 51, 52, 53, 54 and 55 have to be non-metallic and are therefore made of plastic material of suitable, known type. The water fill device 50 as shown and described herein is only for illustrative purposes and may be modified in any manner as known to those skilled in the art. In the actual construction, the water fill device 50 including the valve assembly 52, 53, 54, 55 is preferably accommodated recessed inside the housing 27, for example, within appropriate openings and/or recesses in the corresponding places of the housing and of the insulation 28 in such a manner that only the fill-in opening formed by the end of the filler pipe 51 appears in a recess in the outer, otherwise rectilinear housing shell 27. This is schematically indicated in FIG. 1 for a fill-in device 50*a* to fill water into the area above the heat plate 30, whereby valve and vent devices associated with the fill-in device 50*a* are omitted for the sake of clarity and simplicity. Furthermore, a vent device generally designated by reference numeral 60 (FIG. 2) is provided with the hair-curler system of this invention to prevent the build-up of excessive steam pressure. This steam vent device 60 thereby includes a valve of conventional construction and therefore not shown in detail in the drawing, which is normally held down in the closing position either by gravity and/or spring-loaded and is able to lift upwardly only in the presence of a predetermined pressure of steam to avoid the build up of excessive pressures within the bottom cavity 29. The vent device 60 may thereby be located in any appropriate place within the hair curler system. The water fill device 50 and vent device 60 may also be combined and more than one water fill tube and/or vent device may be provided in different areas of the hair-curler system of this invention. Both of these devices 50 and 60 and for safety reasons in particular the vent device 60, are located on what is to be the rear side of the hair-curler system. Additionally, some indicating device to indicate the amount of water left in the water tank areas may also be provided. For example, a water fill line window 51' schematically shown in FIG. 1 may be used for that purpose to avoid overfilling of the tank(s) in case water from previous use is still left therein. Such a viewing window may be associated with a fill line or may also be located in any appropriate part of the wall delimiting a respective tank. Furthermore, a depth stick, a float or simply tilting the system at an angle to make the water appear at the opening of the fill line may serve for such indication. Similar water fill and vent systems as also indicating devices are also provided in the modified embodiments to be described hereinafter if designed for steam-setting or if the system is to be heated with hot water or with steam. However, for the sake of simplicity, they will not be shown and described again in connection with each such modified embodiment. A bottom water fill device may thereby be provided for the bottom cavity 29 and a top water fill device may be provided for small amounts of water to be supplied to the space above the heat plate 30** in the microwave version while only the top water fill device is used for small amounts of water in the electric version whereas the bottom cavity is not used ordinarily for steam or water in the electric modes.

Figure 19:
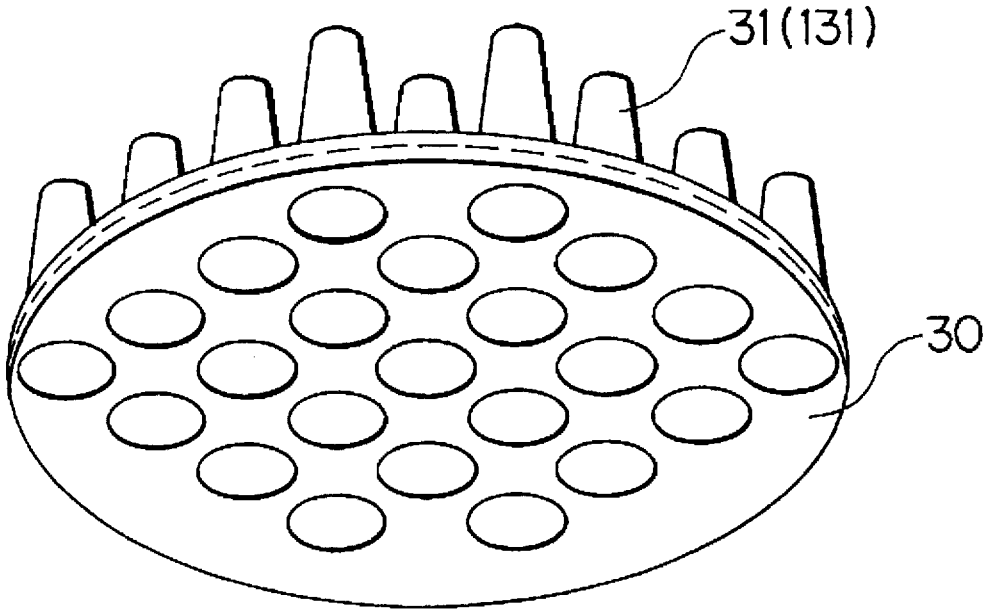
FIG. 19 is a somewhat schematic perspective view, on a reduced scale, of a modified embodiment of a heat plate with a number of hollow heat posts or rods in accordance with this invention.

The heat disk 30 for the microwave version could be made of heat-absorbing material, for example, of glass, Pyrex, Corning Ware, etc. and have heat posts or rods 31 or 131, either hollow or solid, on the top surface of the heat disk 30 (FIG. 19). The heat disk 30 and heat posts or rods 31, 131 could be made all in one solid piece with an open hole in the heat disk under each hollow heat post or rod as also shown in FIG. 11 but without holes in the heating posts or rods.

The top surface of the hair-curler system of this invention is covered by a plastic disk-like plate member 21 made from suitable, non-microwave-absorbing material such as, for example, Nylon or Styrofoam covered by a plastic material, which is suitably bored so as to match the layout of the compartments 34. This plate member 21 is omitted in FIG. 2 for the sake of clarity.

A curler lift assembly consisting of an insulated curler-lift top member 23, of a curler-lift base member 25 and of one or more curler-lift connecting rods 24 joining the curler-lift top member 23 with the curler-lift base member 25 is provided for each hair curler 33 which permits the removal of an individual curler or curlers from the associated compartment (FIG. 9). The curler-lift assembly 23, 24 and 25 thus forms an approximately C-shaped structure with the top and bottom members 23 and 25 having a cross-sectional area at least as large as the top and bottom areas 33' and 33" of the curler(s) 33 whereby lifting of the curler lift assembly is facilitated by a knob 26' formed on the external member 26 of the lift assembly which is secured to, respectively made integral with, the top member 23 by way of rim portion 26". The lift rod(s) 24 may thereby be rectilinear or curved and extend over any suitable arc preferably much less than 180° so as to permit insertion of the curler 33 into the lift assembly. A small protrusion-like stop member or members 25' (FIGS. 9 and 9*a*) may thereby extend in the plane of the curler base member 25 from one or more places of the curler lift base member 25 to prevent the curler lift assembly from being accidentally removed entirely from its compartment 34 when removing a curler from its compartment or heat tube. The length of the stop member(s) 25' is thereby so chosen that the lifter assembly can be readily inserted and removed by canting but cannot be removed from its compartment by axial movement.

Additionally, the curler lift base member 25 is also preferably provided with a rim portion 25" extending peripherally or at least over part of the periphery of the base member 25 to hold a curler in proper position whereby the height d' of the rim portion 25" must be sufficiently smaller than the distance d between the top surface 33'*a* of the curler and the bottom surface 23' of the curler lifter top member 23 to enable easy installation and removal of a curler in and from the curler lift assembly 23, 24, 25. For the sake of simplicity, the stop member(s) 25' and the rim portion(s) 25" are omitted from other figures of the drawing. The various parts 23, 24, 25 of the lift assembly can be made of any suitable firm and rigid material which does not absorb microwave energy and is able to support the weight of the curler(s), such as appropriate plastic material or, for example, plastic-covered Styrofoam for the part 23 with the cap members 26, 26' and 26" made from suitable microwave non-absorbing rubber-like or hard plastic material. In FIG. 1, reference numerals 34 designate the free compartment space about each curler 33 formed by a respective compartment. By making the rim portion 26" larger than the opening in the plate member 21 corresponding to space 34, the curler lift assembly can be inserted to a predetermined depth in a respective compartment.

The curler system illustrated in FIGS. 1 and 2 quickly heats all the curlers 33 at the same time while thoroughly insulating each curler separately so as to improve the heat energy efficiency of the system. The curler system of FIGS. 1 and 2 can thereby be designed to hold several sizes of curlers, even two shorter curlers within a single lift assembly (FIG. 9) and also offers great safety by the vent system 60 to prevent excessive pressure build up, which should always be positioned on the far side of the system to assure the greatest possible safety for the user. The system can be made in reasonably large standard sizes and be reduced down to purse size for touch-ups. However, it may also be made of commercial size for beauty salons, hospitals, beauty schools, etc. It can be made for "dry heat" but can also be readily adapted for "moist steam" as will be explained more fully hereinafter. The size and shapes of the overall system and/or of the inner compartments may be circular, oval, rectangular, square, etc., depending on the size and shape of the curlers. Moreover, the system of FIGS. 1 and 2 can also be modified so that the compartments extend in horizontal positions, either parallel to one another (FIG. 8) or in a spoke-like arrangement (FIG. 6) without departing from the spirit of this invention. Important to the present invention is the use of individual compartments completely insulated from one another to prevent heat losses. If "dry heat" setting of the hair is desired, the interface of the heat disk 30 with the insulation 28, respectively, with the casing 27 could be sealed off to prevent any moisture from the compartment 29 from entering the area above the same.. The end cap members 26 thereby cover a respective compartment 34, extending with their rim portion 26" slightly beyond the openings in plate member 21 to support or suspend the curler lift assemblies. Rubber gaskets (not shown) surrounding the area of such opening may also be provided, for example, vulcanized or otherwise secured to the bottom surface of the rim portion 26" to prevent heat loss whereby the cap members 26 can be coded by size of cap member 26 or can be color-coded to identify the curler size contained in a respective compartment with the curler 33 in a respective compartment 34 the same color as the cap member 26 or 26' and can be made to appropriate size to assure safe seating in a respective compartment.

If "moist heat" hair setting is desired, it is only necessary to provide the plate member 30 as well as the lifter bottom plate member 25 with small openings to permit the passage of steam in predetermined areas which could then reach the hair curlers. In the alternative or in addition to the system described above, a small amount of water could be introduced through another conventional water fill/steam vent device 50*a* (FIG. 1) that services the area just above the heat disk 30. Furthermore, for "moist heat" hair setting, a very small amount of water could also be added through an open-bottom heat tube, to be described more fully hereinafter, onto the surface of the heat plate 30 while temporarily removing and replacing a curler. Moreover, the embodiment of FIGS. 1 and 2 can also be readily adapted to standard electrically heated curler systems by providing an electric heating system to steam the water in compartment 29 utilizing devices of conventional type which can be immersed into the water and heat the water in compartment 29 in any suitable, known manner. In the alternative, cone-shaped or straight dowel-shaped, rod-like electrically heated elements 131' (FIG. 4) of known construction may also be mounted on the plate member 30 which then extend into the hollow inside of the curlers 33 and which are each individually heated electrically by appropriate wire connection. The tops of the cone-shaped or straight dowel-shaped heating rods or posts are preferably pointed or somewhat pointed at the top to allow greater ease of catching the opening in the base of the curler lift so as to be able for the curler to slide down over the heating rod or post with a curler resting and sitting on the base member of the curler lift assembly. In this manner, the heating post or rod will slide easily up through the opening in the base member of the curler lift assembly and into the opening in the bottom of the curler when a corresponding design of the curler and curler lift base member is used.

Figure 3:
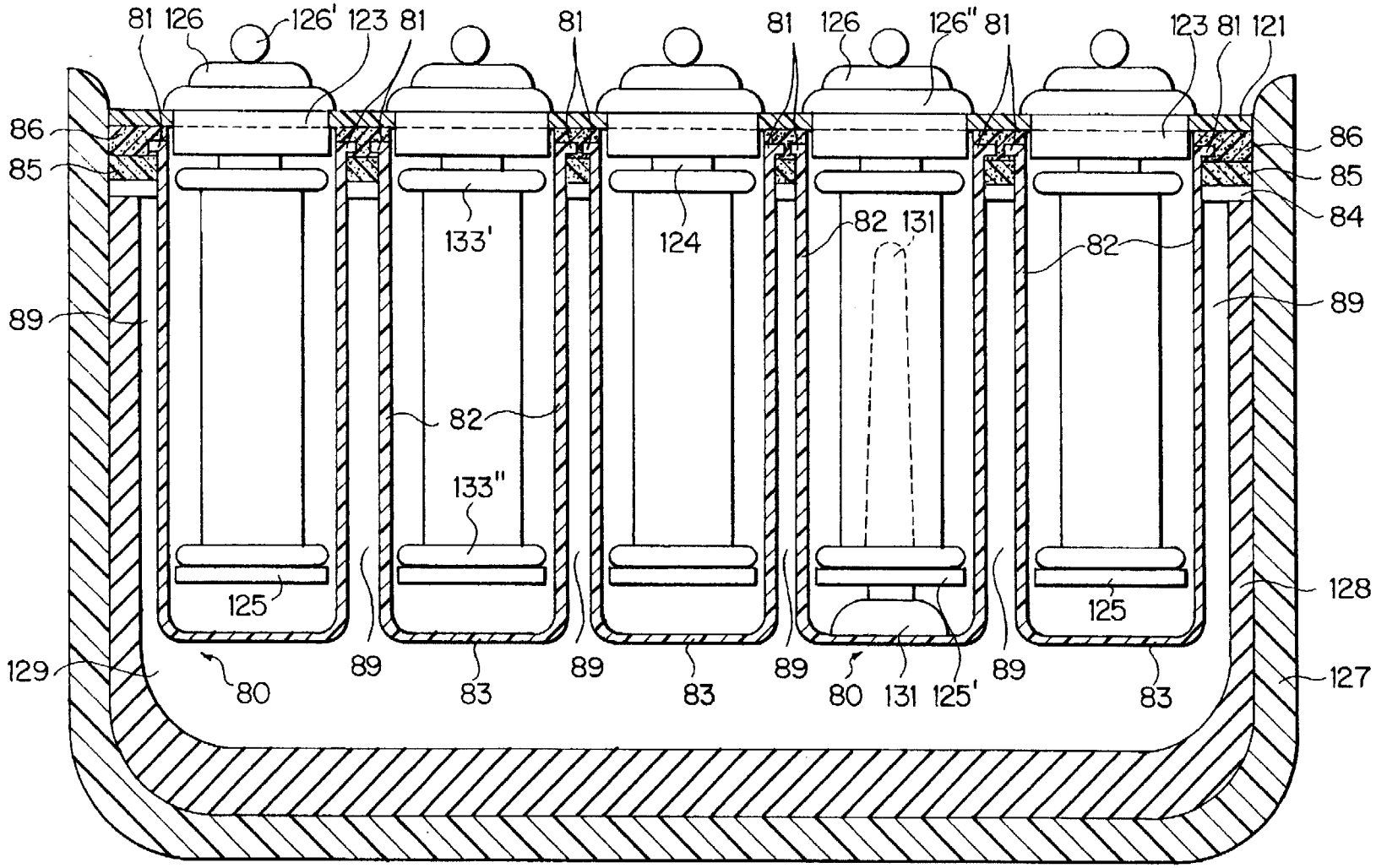
FIG. 3 is a somewhat schematic transverse cross-sectional view, similar to FIG. 1, through a modified embodiment of a hair-curler system in accordance with this invention, particularly suited for microwave heating.
Figure 4:
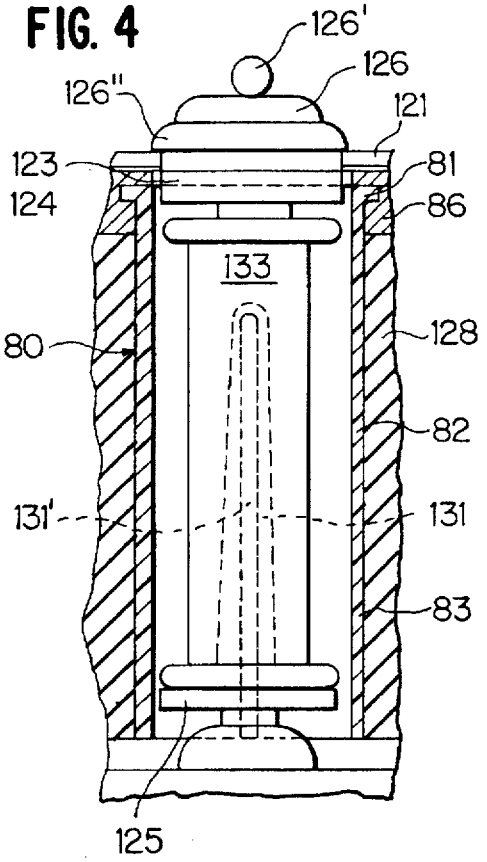
FIG. 4 is a partial somewhat schematic cross-sectional view showing details of an individual heat curler installed in a test-tube-like compartment having an open bottom.
Figure 5:
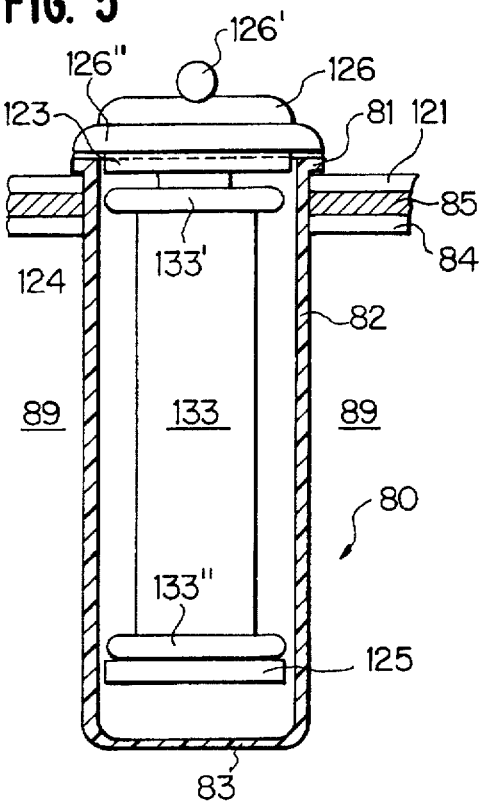
FIG. 5 is a somewhat schematic cross-sectional view showing details of an individual heat curler arranged within a test-tube-like closed compartment.

FIG. 3 is a somewhat schematic cross-sectional view, similar to FIG. 1, illustrating a modified embodiment of the present invention which can be readily modified and adapted to microwave heating or standard electric heating. Reference numerals of the 100 series are used in this embodiment to designate parts corresponding to those of the embodiment of FIGS. 1 and 2 and therefore will not be described in detail in connection with FIG. 3. The housing 127 is provided with an internal insulation liner 128, both of which are microwave transparent. Differing from the embodiment of FIGS. 1 and 2, this embodiment includes separate heat tube members of test-tube-like shape and generally designated by reference numeral 80 each forming an enclosed compartment which is insulated in effect from the other compartments. The test-tube-like members 80, which include side walls 82 and bottom walls 83 and which are made from microwave-energy-absorbing or from heat-absorbing material such as Corning Ware, are supported by means of their annular rims 81 at the upper end of the side walls 82 on an insulating disk 85 which in turn is supported on a rigid and stiff support 84 which could be made of heat-absorbing material resting on the insulating liner 128. The rigid heat-absorbent support 84 is made of a stiff plastic or of a heat-absorbing and possibly heat-storing material, such as Corning Ware material while the insulating disk 85 may be made of insulating material such as Styrofoam. The annular rims 81 and/or the rim portions 126" could also have a rubbery gasket material fused under each rim or rim portions to protect moisture from escaping the spaces 89 and 129. In that case the rims 81 with their fused-on gasket-like material could also rest directly on the rigid support 84 of plastic or heat-absorbent material instead of on the Styrofoam insulating layer 85 for a firmer seal. In the alternative, an insulating disk 86 made, for example, of Styrofoam, may also be provided which is grooved or undercut to accommodate the annular rims 81 of the heat tube members 80 supported thereon and which rests on the insulating disk 85. However, as shown in FIG. 5, the bottom of rim portions 126" provided with a fused-on rubber gasket may also rest on annular rim 81 and the annular rim 81 provided with a fused-on rubber gasket may now rest on the top surface of cover plate member 121. Cover plate member 121 made of plastic material again forms the top of the curler system. It is, of course, understood that all of the members 84, 85, 86 and 121 are provided with openings conforming to the number and shapes of the heat tube members 80. Cap member 126 is again connected with the insulated top member 123 of the lift assembly 123, 124, 125 and is provided with a handle portion 126' to facilitate removal of the curler lift assembly together with a respective hair curler. Reference numerals 89 designate in FIG. 3 the empty spaces which are left between the heating tube members 80 whose bottom surfaces 83 are freely exposed to the space 129 which may be filled with a lossy dielectric material such as rice to heat the area above the space. With test-tube-like members 80 made from heat-storing material such as Corning Ware, the individual compartments are also insulated in effect from one another so as to achieve energy efficiency. In this embodiment, the individual compartments formed by the test-tube-like members 80 are fully enclosed; however, they may also have an open bottom (FIG. 4). The fully enclosed heating tube members can be compared to tiny oven-like containers that each accommodate one or more curlers by a lift assembly. Moreover, each test-tube-like member 80 could also have a heat rod 131 positioned on the inside of the bottom 83 and either fixed thereto as an integrally molded part of the heat tube member or removable therefrom. The fixed heat-tube rod or post 131 may be hollow and integrally formed as part of the heat tube member 80. This would allow steam not only to encircle the sides 82 and bottom 83 of the heat tube member but would also permit steam to reach up inside of the actual heat post or rod through a possible opening in the bottom of the heat tube member to more efficiently heat the curler into which the heat post or rod is inserted. In case of electric units, the rigid support 84, the heat tube members and heat posts could all be of metallic materials of known type. Though insulation 128 is shown in FIG. 4, the embodiments of FIGS. 3, 4 and 5 dispense with the need for insulation between the side walls 82 of adjacent heat tube members and about the bottom S3 of the heating tubes 80 which in turn will allow steam or dry heat to freely circulate around the major outer surfaces of each heating tube 80. As a result thereof, the heating tubes 80, made of heat-retaining material such as Corning Ware, will be heated, causing the rod 131 and/or the curler 133 within the heating tube members 80 to be heated. The fully enclosed test-tube-like construction shown in FIGS. 3 and 5 will also keep each curler 133 dry, if so desired, and will retain heat within each separate compartment formed by a respective member 80 while one or more curlers are removed from their respective compartments. When the unit is designed for microwave energy, the heating posts or rods 131 can be made of or, if hollow and having proper vents, could be filled with lossy dielectric material or consist of heat-absorbing material, such as Corning Ware, Pyrex, glass, etc., and can also absorb and store the heat energy from the boiling water and steam in the cavity 129. As is known, lossy dielectric materials, such as water and even dry rice, when subjected to microwave energy, convert such microwave energy into heat which, in case of rice and of boiling water or steam, is then absorbed by the heat-absorbing and heat-storing material, such as Corning Ware. However, as mentioned before, the heating posts or rods 131 can also be made of metallic material of any known type if the unit is designed for electric heating.

FIG. 4 shows an embodiment in which each compartment is delimited by a heat tube member 80, 81, 82, similar to that of FIGS. 3 and 5 except that it is open at the bottom. Moreover, insulating material 128 may be used to surround the majority of the outer areas of the surfaces 82 as shown in FIG. 4. The member 80 is again suspended by an annular rim 81, which may be provided with fused-on gasket material on its underside, which rests on the top surface of cover plate member 121 of the curler unit 133 that may also include a heat post 131 extending into the compartment from below. Such a gasket may also be secured on the top surface of plate member 21, 121 and/or around the bottom surface of the outer edges of rim portion 26", 126" of cap members 26, 126 or around edges of openings 34, 134. The heat post base (not shown) could be attached to an electrical heating system (not shown) or the bottom of a heat post may be attached by any known means to a heating disk such as disk 30 in FIG. 1 in a microwave unit in which the heat posts or rods could be solid and of a heat-absorbing material or of a lossy dielectric material or hollow and filled with a lossy dielectric material. One of the best modes of construction is as shown in FIG. 19. With a closed heat tube 80, a snap-on attachment to the bottom 83 may also be possible in some applications. The suspension of the heat-tube member 80 in FIG. 5 makes it very easy to remove each heat-tube member to clean the same or to replace the same with another type, either with closed bottom or open bottom. To enable a free choice of either a hollow curler or a solid curler, the heat posts 131 could be made attachable and detachable with a snap-in bottom 83 for closed bottom heat tubes 80. By leaving open spaces 89 around the heat-tube members 80 assures maximum circulation of heat whereby these heat tubes 80 are made from any material, known as such in the art that absorbs and retains heat for long periods of time.

Figure 6:
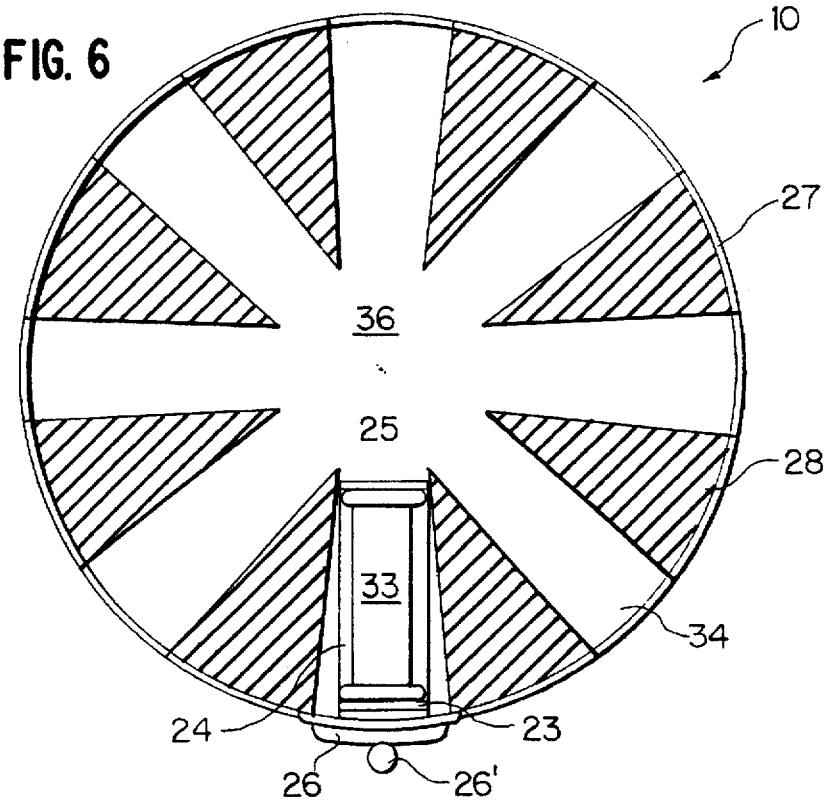
FIG. 6 is a somewhat schematic horizontal cross-sectional view through a still further modified hair-curler system in accordance with the present invention in which the curlers are disposed radially and horizontally or on a slant.

FIG. 6 is a somewhat schematic top plan view showing a modified embodiment of the curler system of this invention in which the insulated compartments 34 are arranged in a radial fashion whereby a vertical duct 36 is connected with the space 29 above the plate 30 in the housing of a microwave-type curler unit.

FIG. 7 is a somewhat schematic top plan view of one type of heating rod structure 35 that could be utilized in a unit such as the unit shown in FIG. 6. The rods 31 could hold one or more than one curler in each of the separate insulated compartments 34 provided each curler is open at both ends to permit a rod to pass completely through all of the curlers, or each curler is able to rest in a horizontal position or at a slant on a curler lift assembly such as shown in FIG. 12.

Additionally, FIGS. 6 and 7 could be made in an electric mode.

FIG. 8 is a schematic cross-sectional view illustrating a still further modified embodiment in accordance with the present invention in which two rows of compartments 34 are arranged in a horizontal position one above the other, whereby openings are provided in the insulation to allow electric heat posts 31 or lossy dielectric material in heat rods or heat tubes to heat the curlers.

FIG. 9 is a somewhat schematic elevational view of a curler lift assembly 23, 24, 25, 26, 26', 26" in accordance with the present invention which retains two shorter curlers 33. The curler lift assembly 23, 24, 25, 26, 26', 26" of FIGS. 9 and 9A also includes a radially projecting stop member 25' projecting from the base member 25 a predetermined distance to permit complete removal of a curler lift assembly from its compartment only by canting to thereby prevent inadvertent complete removal. To accommodate the extension of the radially projecting stop member 25' and still obtain a stopping action at the top exiting position of the curler lift assembly parts 23, 24, 25, 26, 26', 26", the diametric dimension of the insulated spaces 34 in FIG. 1 and the like may be sized slightly larger than the cored-out openings in the cover member 21 and the like. For holding a curler in proper position on its curler lift assembly, a rim 25" is also provided on the base member 25 which extends over a predetermined arc, whereby the spacing d must be sufficiently larger than the distance d' to allow installation of a curler.

FIG. 10 is a somewhat schematic partial cross-sectional view illustrating a modified embodiment of a curler system in accordance with the present invention in which the electrical cord 38 for the electrical heating device 39 of any conventional type can be stored in a cord storage compartment 40 formed in the housing 27 underneath the insulation 28 whereby this storage compartment may be closed by a conventional cover (not shown). Reference numerals 46 indicate a number of non-skid feet to assure a stable and safe support of the equipment.

FIG. 11 is a somewhat schematic elevational view illustrating a curler lift assembly 23, 24, 25, 26, 26', 26" with the curler 33 in place mounted on a hollow heating rod 31 which is provided with small holes 31' to permit steam or dry heat to pass from the base of the unit into the curlers.

FIG. 12 is a somewhat schematic elevational view of a curler lift assembly with two rods 24' suitably spaced along an arc of the circumference of the lift assembly to permit use in any position such as vertical, horizontal or slanted position, as required in FIGS. 6 and 8.

FIG. 13 is a somewhat schematic bottom view of a curler lift base member **25*a* having a solid surface whose lift rod 24 protrudes beyond the circumference of the base. However, the base member 25*a* of FIG. 13 may also be open at the bottom as indicated by opening 61, it being understood that this opening 61** can also be made smaller or larger to any desired size.

FIG. 14 schematically illustrates a curler lift base member **25*b* provided with a grated bottom generally designated by reference numeral 63 and consisting of bars 62. It is, of course, understood that the grating design may be changed, for example, by utilizing narrower or wider grating bars 62** and extending the same in any desired direction.

Figure 15:
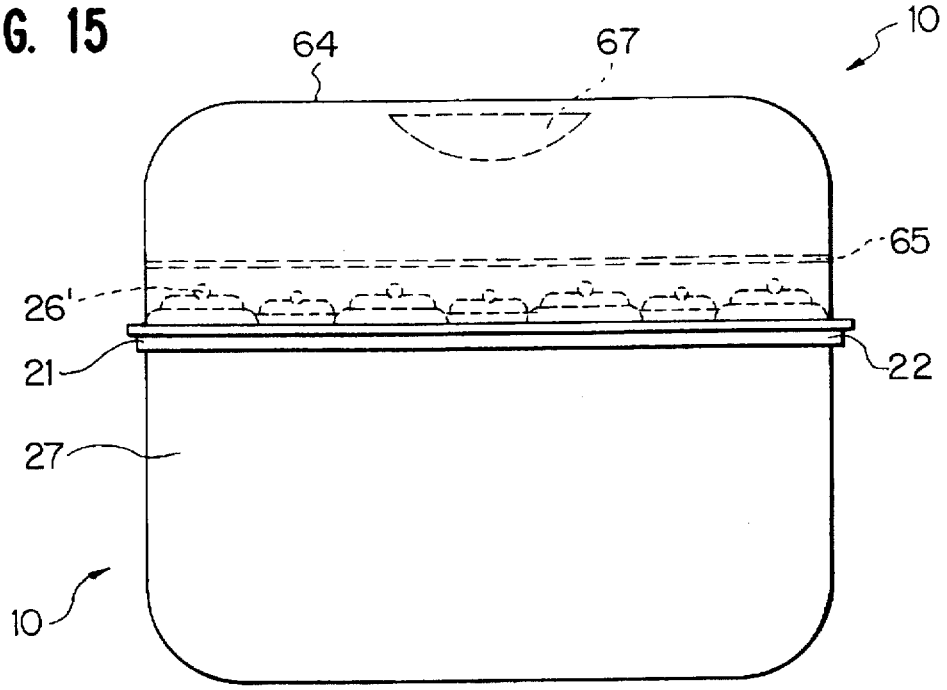
FIG. 15 is a somewhat schematic elevational view, illustrating an embodiment of a hair curler system of this invention with a removable storage lid in place on top of the apparatus and provided with a recessed handle.

FIG. 15 is a somewhat schematic elevational view of a curler unit 10 with a storage lid generally designated by reference numeral 64 for storing accessory items such as curlers, combs, etc. which is mounted on top of the unit and includes a recessed handle 67 that will permit the lid to lay flat when the lid or the entire unit is turned upside down. A grating 65 may be provided inside the lid 64 which allows air to pass freely through its spacings, some of these openings being sufficiently large to permit fingers to be inserted into the same so as to enable turning of the grating 65 to be locked in place temporarily within the storage lid 64, respectively, removed therefrom by means of a bayonet-type locking device (not shown) including circumferentially spaced recesses in the grating cooperating with inwardly directed projections on the lid. The lid 64 is thereby removed when using the unit, especially before placing the unit into a microwave oven. To permit evaporation of any remaining moisture in the compartments when the unit is turned upside down after use, the lid 64 now installed on the unit is also provided with a suitable number of openings of adequate size and shape which are located in any appropriate part of the lid, for example, in the annular space between the grating 65 and the bottom edge of the lid.

FIG. 16 is an elevational view of the cap member 23 of a lifter assembly whose knob member **26*a* mounted on a stem 26*a'* is so constructed as to be movable vertically within a slot 26*b* provided in cap member 26 and in the top part of rim portion 26" but preferably not extending into the curler top member 23. The cap member 26 should have enough height for the knob stem 26***a'* because it is preferable that the knob stem 26*a'* does not extend down into the insulation of curler lift top member 23. Suitable, known means such as a conventional detent mechanism may be provided to limit and hold the upward vertical movement of the knob member 26*a* which is used to indicate, for example, when in the extended position, that the compartment covered by the curler lift lid member 23 is empty, i.e., the curler(s) of the corresponding lifter assembly is in use. This will alert the user that the curler from this compartment is already in use. Of course, the size and shape of the knob member 26*a* and its movability as well as locking or detent means in the extended and retracted position may be varied at will as known to those skilled in the art. A pivotally mounted tab or flap member pivotally mounted on the cap member and adapted to be pivotally raised into the vertical position may also be used as curler use indicator. The cap member 26 and possibly also the rim portion 26" may be made of a hard plastic material and the curler lift member 23 of an insulating foam material that could be covered on the insulation bottom and the side surfaces with a thin layer of a plastic material preferably forming a smooth surface or even with a rubbery plastic material. Though in FIG. 16 the stem 26*a'* extends only down into the cap member 26 and rim portion 26", it could optionally also extend down into the curler lift top member 23.

Figure 17:
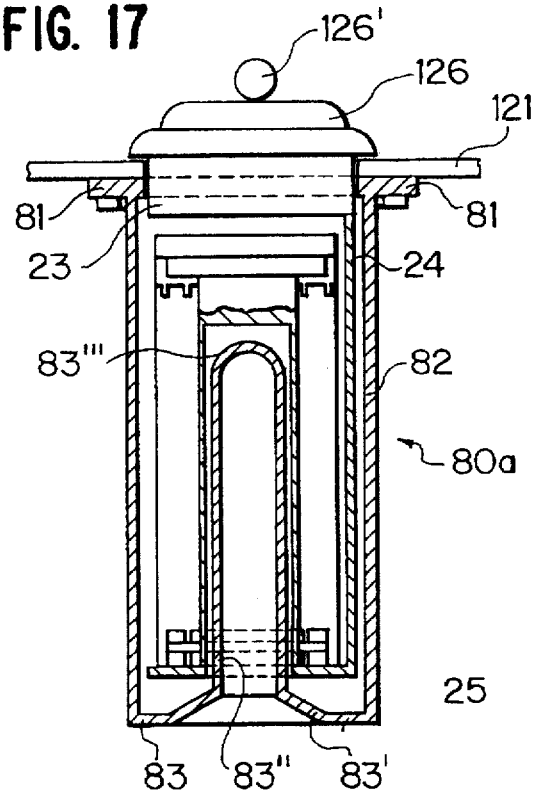
FIG. 17 is an elevational view of a modified embodiment of a test-tube-like heat-tube compartment having a closed bottom which is drawn inwardly to accommodate a heating post or rod.
Figure 18:
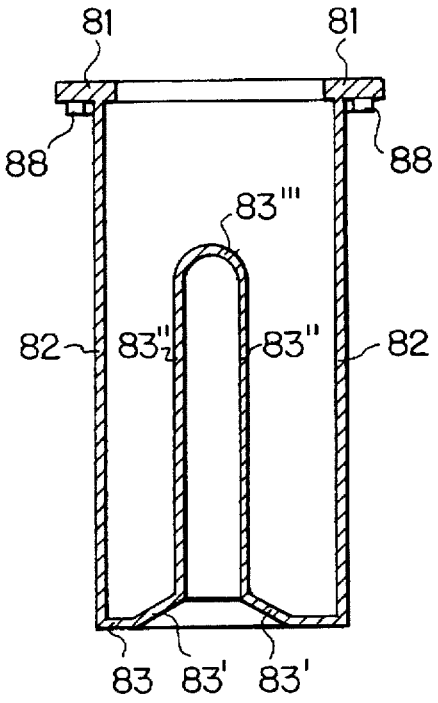
FIG. 18 is a somewhat schematic cross-sectional view of the test-tube-like compartment of FIG. 17 by itself, also indicating the possible flow of heat or steam around the closed compartment.

FIGS. 17 and 18 illustrate a modified embodiment of a heat tube 80*a* with a closed bottom that includes a small circular flat portion 83 adjoined by an inwardly upwardly slanting portion 83' which is followed by a vertically rising portion 83" that terminates in a circular portion 83'". With a heat tube 80*a* of circular shape, all portions 83 and 83' are, of course, annular with the walls 83", 83'" forming a closed circular recess to receive a heat post or rod 31, 131. The heat tube 80*a*, which may be made of heat-absorbing and heat-storing material such as Corning Ware, will permit heat or steam to go up into the central circular opening as well as circumcirculate the bottom parts 83 and 83' as well as the side walls 82. The heat posts 31, 131 may also be filled with a lossy dielectric material or the central space formed by wall portions 83", 83'" as possibly also the space around the heat tubes may itself be filled with a lossy dielectric material for microwave use. An appropriately shaped and dimensioned plug member may be used to close off the bottom of the open space defined by wall portions 83" and 83'" to hold in place any lossy dielectric material placed into this central space. Such a plug member is also provided with a vent opening for heat pressure release. Moreover, the heat tubes 80 or 80*a* may also be made themselves of lossy dielectric material. FIG. 17 also shows schematically a two-partite curler assembly adapted to be extended and retracted as well as locked in the extended and retracted positions, as more fully described in my copending application Ser. No. 08/469,694, filed on even date and entitled "Two-Partite Hair Curler Assembly," now U.S. Pat. No. 5,573,016, the subject matter of which is incorporated herein in its entirety to dispense with a detailed description. If a two-partite hair curler or other hair curler without a curler lift is used, the heat tube 80*a*, 83, 83', 83" and 83'" may also serve to hold such a two-partite hair curler or other curler without curler lift in place whereby the heat tube 83" and 83'" has such a height that it will allow the cap 23 of the two-partite hair curler or other curler to be just above the outer surface 21, 121 while it is heated. After such a curler is removed, a separate cap 26, 126 could then be placed into opening 34 to provide insulation and prevent unnecessary loss of the remaining heat. The underside of the flanges 81 and/or of the top surface 21, 121 may again be provided with a circular fused-on gasket ring 88 to seal the space 89.

FIG. 19 is a somewhat perspective view of a one-piece heat plate 30 provided with hollow heat posts 31, 131 which may be formed integral, i.e., in one piece therewith, whereby the heat plate 30 is provided with openings underneath the heat posts 31, 131 to permit steam or dry heat to rise into the heat posts. In an electric system the heat posts and possibly also the heat plate may be of metallic construction whereby an electric heating element might also be inserted into each heat post. For microwave use, glass, Pyrex, Corning Ware and the like may be used as the material therefor whereby the heat posts may also be filled with lossy dielectric materials. To hold the lossy dielectric material in place within the heat posts 31, 131, for example, a plug or another disk (not shown) may be placed underneath the heat disk 30 held in place within recess or groove 28', whereby appropriate vent holes are provided in such plugs or disks.

While I have shown and described several embodiments in accordance with the present invention, it is understood that the same is not limited thereto but is susceptible of numerous changes and modifications as known to those skilled in the art. For example, any known materials may be used for the parts of this invention which offer the characteristics ascribed thereto. Moreover, during use of a curler, the opening for each compartment may also be closed by a separate plug member of suitable construction to seal the opening if the empty curler-lifter with its cap is not returned for that purpose. The cap member of the curler lift assembly may be arranged within a corresponding opening in the area of the upper insulation of the curler system or may rest directly on the insulation. The connecting rod(s) 24 may be of any cross-sectional shape, such as square, rectangular, circular, oval, etc., or could also be of a different cross section to increase the up-and-down guidance of the lifter assembly. For example, a construction using two connecting members 24 connected with each other and adapted to slide in a complementary cross section provided in the openings 34 would assist in the sliding guide function, whereby those two connecting members could be connected side-by-side or preferably one behind the other in the radial direction of the lifter base member. Of course, the connecting members may also be of integral one-piece construction having the desired irregular cross section configuration. Additionally, the heat plate may be flat or curved with the space 29 or 129, 89 filled with lossy dielectric material. Furthermore, the heat plate 30 could also be extended so as to conform to the inside of the space 29, 129 to form itself a closed cavity filled with a lossy dielectric material and provided with vent(s) as needed. This latter construction is also possible with heat posts or rods 31, 131 integral with the heat plate as shown in FIG. 19. I therefore do not wish to be limited to the details shown and described herein, but intend to cover all such changes and modifications as are encompassed by the scope of the appended claims.

I claim:

1. A curler system for heating hair curlers, comprising housing means, further means forming a plurality of individual compartment means within said housing means open toward the outside and adapted to be closed off with respect to the outside, each compartment means being adapted to accommodate at least one hair curler, and additional means for each compartment means operable to insert, respectively, remove at least one curler from the corresponding compartment means, said further means effectively providing insulation means for each compartment means, and means for enabling heating said hair curlers within said housing means by microwave energy external of said housing means including means for minimizing loss of heat from the system upon removal of a curler.

2. A curler system according to claim 1, wherein said further means includes cover means for each compartment means to cover the same heat-insulatingly with respect to the outside, and wherein said additional means includes curler lift means for each compartment means.

3. A curler system according to claim 2, wherein said cover means is part of the curler lift means so that a corresponding compartment means can be closed off again by reinserting its curler lift means after removal of the curler from the curler lift means.

4. A curler system according to claim 2, wherein said cover means is separate from the curler lift means.

5. A curler system according to claim 2, wherein said cover means includes a separate cap for each compartment means.

6. A curler system according to claim 1, wherein said insulation means is formed at least in a large part within said housing means, and wherein said compartment means are formed by openings of predetermined depth and width in the insulation means so that individual compartment means are insulated from other compartment means by said insulation means at least along the sides extending in the depth direction of the housing means.

7. A curler system according to claim 1, further comprising a heat plate means delimiting a space in the bottom area of the housing means from the area accommodating the compartment means.

8. A curler system according to claim 7, wherein said heat-plate means includes hollow heat post means.

9. A curler system according to claim 8, wherein said heat-plate means is provided with individual openings to provide a communication between said space and the interior of the heat post means.

10. A curler system according to claim 8, wherein said heat post means are filled with a lossy dielectric material, and means for holding the lossy dielectric material in place within said heat post means.

11. A curler system for steam-setting according to claim 7, further comprising means for filling said space with water and vent means for preventing the build up of excessive steam pressure in said space.

12. A curler system according to claim 11, wherein said filling means includes a normally closed valve means and adapted to open in the direction toward the space in the presence of predetermined force on its top while said vent means includes normally closed valve means adapted to open up in the direction away from said space in the presence of a predetermined steam pressure in said space.

13. A curler system according to claim 7, wherein at least one area within said housing means is adapted to receive water, and a water fill-in means for each such area.

14. A curler system according to claim 13, further comprising indicating means for indicating the water level in said at least one area.

15. A curler system according to claim 13, wherein one of said areas is said space and wherein another of said areas is on the surface of said heat-plate means facing the area accommodating said compartment means.

16. A curler system according to claim 13, wherein said housing means is lined with insulation means, and wherein the inlet of each water fill-in means is located recessed in said housing means and in at least part of the insulation means lining said housing means.

17. A curler system according to claim 7, further comprising means including said plate means for sealing the area accommodating the compartment means with respect to water and steam in said space.

18. A curler system according to claim 7, wherein said plate means is made from a material absorbing and storing heat produced by one of steam and an electric heating source.

19. A curler system according to claim 7, wherein for dry heat hair setting, curlers in respective compartment means are heated by heat given off by said plate means.

20. A curler system according to claim 7, wherein curlers in said compartment means are heated by heat post means extending into a respective curler means.

21. A curler system according to claim 20, wherein said heat post means are heat-transferringly connected to said plate means.

22. A curler system according to claim 20, wherein said heat post means are hollow.

23. A curler system according to claim 20, wherein said heat post means are solid heat posts.

24. A curler system according to claim 20, wherein said heat post means are hollow and form an integral part of the heat-plate means which is provided with an individual opening for each hollow heat post means to permit steam from said space to enter into each hollow heat post means to heat respective curlers into which the heat post means extend.

25. A curler system according to claim 20, wherein said heat post means are electrically heated.

26. A curler system according to claim 7, further comprising insulation means in said housing means, and wherein the water in said space is heated by microwave energy, whereby both said housing means and said insulation means are substantially transparent to microwave energy.

27. A curler system according to claim 7, wherein water in said space is electrically heated to produce steam.

28. A curler system according to claim 7, wherein for purposes of steam setting, said plate means is provided with opening means through which steam can escape into the area accommodating the compartment means.

29. A curler system according to claim 7, wherein said space is filled with a lossy dielectric material.

30. A curler system according to claim 7, wherein said plate means includes a material absorbing and storing heat produced by microwave energy.

31. A curler system according to claim 1, wherein said further means forms a separate compartment for each individual curler.

32. A curler system according to claim 1, wherein said enabling means includes lossy dielectric material.

33. A curler system according to claim 1, wherein said housing means is made from a material transparent to microwave energy.

34. A curler system according to claim 33, further comprising insulation mean on the inside of the housing means, said insulation means being also made form a material transparent to microwave energy.

35. A curler system according to claim 1, wherein said heating means includes a part made of a material which is at least one of being responsive to microwave energy or of lossy dielectric material.

36. A curler system according to claim 35, wherein said part is a heating disk responsive to microwave energy.

37. A curler system according to claim 35, wherein said lossy dielectric material is arranged in the housing means in proximity to said curlers.

38. A curler system according to claim 1, wherein said additional means includes an approximately c-shaped curler lift assembly forming a curler housing for a curler which may be inserted into and removed from said curler housing.

39. A curler system for heating hair curlers, comprising housing means, further means forming a plurality of individual compartment means within said housing means open toward the outside and adapted to be closed off with respect to the outside, each compartment means being adapted to accommodate at least one hair curler, and additional means for each compartment means operable to insert, respectively, remove at least one curler from the corresponding compartment means, said further means effectively providing insulation means for each compartment means, and wherein said insulation means include heat tube means of heat-absorbing and heat-storing material which form said compartment means and effectively insulate the space between compartment means against heat loss.

40. A curler system according to claim 39, wherein said heat-tube means are made from material operable to absorb and store heat from a heat source including boiling water, lossy dielectric material exposed to microwave energy, steam or electrical heat.

41. A curler system according to claim 39, wherein said heat-tube means have annular flanges at the end thereof open toward the outside, and wherein the heat tube means are supported in the housing means along said flange means.

42. A curler system according to claim 39, wherein the heat tube means are of test-tube-like shape, open only at one end.

43. A curler system according to claim 39, wherein said heat-tube means is formed as hollow heat post means at its end opposite its end open toward the outside to enable heat to proceed upwardly into the heat post means.

44. A curler system according to claim 43, wherein said heat post means forms a barrier for steam as heating source to keep the inside of the heat-tube means dry.

45. A curler system according to claim 43, wherein said heat post means is filled with a lossy dielectric material for microwave use and includes means to hold the lossy dielectric material in place within said heat post means.

46. A curler system according to claim 39, wherein the heat-tube means are surrounded by open spaces.

47. A curler system according to claim 39, wherein said heat-tube means are open on the bottom opposite the end open toward the outside, and wherein insulation means surrounds the heat tube means along the surfaces extending in the depth direction thereof.

48. A curler system according to claim 47, wherein a heat rod means extends into the open bottom of a heat-tube means.

49. A curler system according to claim 48, wherein said heat rod means is hollow.

50. A curler system according to claim 49, wherein said heat rod means is in one piece with its heat tube means.

51. A curler system according to claim 49, further comprising a heat plate means in said housing means forming a partition between the area accommodating the heat tube means and another area and wherein said heating rod means are integral with said heat plate means which is provided with an opening for each hollow heat rod means to enable heat to enter into said heat rod means.

52. A curler system according to claim 39, further comprising a heat plate means delimiting a space in the bottom area of the housing means from the area accommodating the compartment means.

53. A curler system according to claim 52, wherein said heat-plate means includes hollow heat post means.

54. A curler system for steam-setting according to claim 53, further comprising means for filling said space with water and vent means for preventing the build up of excessive steam pressure in said space.

55. A curler system according to claim 54, wherein said heat-plate means is provided with individual openings to provide a communication between said space and the interior of the heat post means to allow steam from said space to enter the interior of said heat post means.

56. A curler system according to claim 38, wherein said heat tube means of test-tube-like shape are provided in the bottom thereof with at least one opening to permit the entry of steam for heating curlers accommodated in respective compartment means.

57. A curler system for heating hair curlers, comprising housing means, further means forming a plurality of individual compartment means within said housing means open toward the outside and adapted to be closed off with respect to the outside, each compartment means being adapted to accommodate at least one hair curler, and additional means for each compartment means operable to insert, respectively, remove at least one curler from the corresponding compartment means, said further means effectively providing insulation means for each compartment means, and wherein each additional means comprises curler lift means including a top member, a base member, and at least one connecting member connecting said top and bottom members, at least the base member having an area at least as large as the area of the corresponding end of the curler it is supposed to accommodate, whereby each curler lift means is approximately C-shaped surrounding a respective curler on three sides thereof.

58. A curler system according to claim 57, wherein the base member includes projection means to prevent removal of the curler lift means from its compartment means in case of only axial movement.

59. A curler system according to claim 57, wherein the base member includes a rim means of limited height at least along part of its circumference to retain the base of a curler in proper position on said base member.

60. A curler system according to claim 57, wherein each curler lift means includes a cap member connected to the top member.

61. A curler system according to claim 60, wherein each cap member includes means for indicating the removal of a curler from its respective curler lift means.

62. A curler system for heating hair curlers, comprising housing means, further means forming a plurality of individual compartment means within said housing means open toward the outside and adapted to be closed off with respect to the outside, each compartment means being adapted to accommodate at least one hair curler, and additional means for each compartment means operable to insert, respectively, remove at least one curler from the corresponding compartment means, said further means effectively providing insulation means for each compartment means, further comprising a flat lid for said housing means including a recessed handle, means including openings in said lid to enable any remaining moisture to evaporate when the system is in its stored position, and grating means on the inside of said lid for storing accessories such as curlers and combs and adapted to be lockingly installed and removed by a bayonet-type locking arrangement.

63. A curler system for heating hair curlers, comprising housing means, further means forming a plurality of individual compartment means within said housing means open toward the outside and adapted to be closed off with respect to the outside, each compartment means being adapted to accommodate at least one hair curler, and additional means for each compartment means operable to insert, respectively, remove at least one curler from the corresponding compartment means, said further means effectively providing insulation means for each compartment means, further comprising heat tube means for each compartment means to assist in holding a respective curler in place in such a manner that the top of the respective curler substantially closes a respective opening of the compartment means which upon removal of the respective curler can be closed off by a plug member.

* * * * *